US007507045B1

(12) United States Patent
Harris et al.

(10) Patent No.: US 7,507,045 B1
(45) Date of Patent: Mar. 24, 2009

(54) MULTIPLE ATTITUDE LOW PAPER SENSOR MECHANISM

(75) Inventors: Richard H. Harris, Raleigh, NC (US); Dean F. Herring, Youngsville, NC (US); Tsuyoshi Sanada, Lihilitho Rise (SG)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/202,616

(22) Filed: Sep. 2, 2008

Related U.S. Application Data

(63) Continuation of application No. 12/140,638, filed on Jun. 17, 2008.

(51) Int. Cl.

| | |
|---|---|
| ***B65H 26/08*** | (2006.01) |
| ***B65H 26/00*** | (2006.01) |
| ***B41J 15/04*** | (2006.01) |
| ***B41J 15/02*** | (2006.01) |

(52) U.S. Cl. ..... 400/613; 242/595.1

(58) Field of Classification Search ..... None
See application file for complete search history.

(56) References Cited

U.S. PATENT DOCUMENTS

| | | | | |
|---|---|---|---|---|
| 2,417,553 | A * | 3/1947 | Jensen | 280/47.12 |
| 3,279,717 | A * | 10/1966 | Schubert | 242/554 |
| 5,629,672 | A | 5/1997 | Brown et al. | |
| 5,713,678 | A | 2/1998 | Smith et al. | |
| 5,820,068 | A * | 10/1998 | Hosomi et al. | 242/563 |
| 6,135,384 | A | 10/2000 | Skelly et al. | |
| 6,502,784 | B1 | 1/2003 | Sato | |
| 2006/0285908 | A1 * | 12/2006 | Salussolia et al. | 400/613 |

* cited by examiner

*Primary Examiner*—Daniel J Colilla
(74) *Attorney, Agent, or Firm*—Cantor Colburn LLP; Jason Piche

(57) ABSTRACT

A low paper sensor mechanism for a printer includes two paper supports. Each paper support includes a fixed roller rotatable about a fixed roller axis and a movable roller rotatable about a movable roller axis and pivotable about the fixed roller axis from a start position to an end position, the movable roller and fixed roller spaced a predetermined distance apart and capable of supporting a paper supply roll. A detection device includes a sensor having an emitting element and a detecting element disposed in a line of sight of the detecting element. The movable roller is translatable from the start position toward the end position as a diameter of the paper supply roll decreases to less than or equal to the predetermined distance thereby allowing the paper supply roll to fall between the fixed roller and the movable roller thereby restoring the line of sight.

1 Claim, 4 Drawing Sheets

MULTIPLE ATTITUDE LOW PAPER SENSOR MECHANISM

CROSS-REFERENCE TO RELATED APPLICATION

This application is a continuation of U.S. patent application Ser. No. 12/140,638, filed Jun. 17, 2008, the disclosure of which is incorporated by reference herein in its entirety.

BACKGROUND OF THE INVENTION

1. Field of the Invention

This invention relates generally to printers and, more particularly, to low paper sensor mechanisms for printers.

2. Description of the Background

Presently, there are several different types of printers available. However, all printers share common components, such as a print head, a platen, a paper supply and a control mechanism. The control mechanism controls a motion of the print head relative to the paper supply, selects a character to be printed, and advances the paper supply, as necessary.

Regardless of the type of printer used, it is generally undesirable to operate a printer without paper. For example, ink-based printers that are operated without paper will transfer ink into the platen, which may, in turn, stain a back side of subsequent sheets of paper and may also damage print writes within the print head. Also, thermal printers that are operated without paper may overheat, since the paper is also used to absorb heat generated by the print head during printing operations. In addition, operating thermal printers without paper may cause excessive wear to the print head, since the print head would be running directly on the platen, instead of on the paper.

Therefore, in order to avoid operating the printers without paper, conventional printers have been provided with low-paper sensing and warning systems. Low paper sensing has recently become an important requirement, as retailers move towards system management, which requires system notification that a paper supply is near completion. Further, as printers are at times wall mounted, and at other times table mounted, printer having a low paper sensor mechanism which operates whether the printer is in a wall mounted orientation or in a table mounted configuration would be well received in the art.

SUMMARY OF THE INVENTION

The shortcomings of the prior art are overcome and additional advantages are provided by a low paper sensor mechanism for a printer including two paper supports, the first paper support supportive of a paper supply roll when the printer is mounted to a substantially horizontal surface and the second paper support supportive of the paper supply roll when the printer is mounted to a substantially vertical surface. Each paper support includes a fixed roller rotatable about a fixed roller axis and a movable roller rotatable about a movable roller axis and pivotable about the fixed roller axis from a start position to an end position, the movable roller and fixed roller spaced a predetermined distance apart and capable of supporting a paper supply roll. A biasing member is in operable communication with the movable roller and is capable of biasing the movable roller toward the end position.

The mechanism includes a detection device including a sensor having an emitting element and a detecting element, the emitting element being disposed in a line of sight of the detecting element. The detection device includes a paddle assembly having two paddles, one paddle extending beneath each paper support from a central bar and a trip arm extending from the central bar; and a paddle biasing member located to bias the trip arm to disrupt the line of sight.

The movable roller is translatable from the start position toward the end position as a diameter of the paper supply roll decreases to less than or equal to the predetermined distance thereby allowing the paper supply roll to fall between the fixed roller and the movable roller thus exerting a force on one paddle of the two paddles causing the paddle assembly to rotate about a bar axis thereby restoring the line of sight.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution which precisely detects a low paper condition utilizing the same detection device whether the printer is mounted on a horizontal surface or on a vertical surface.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
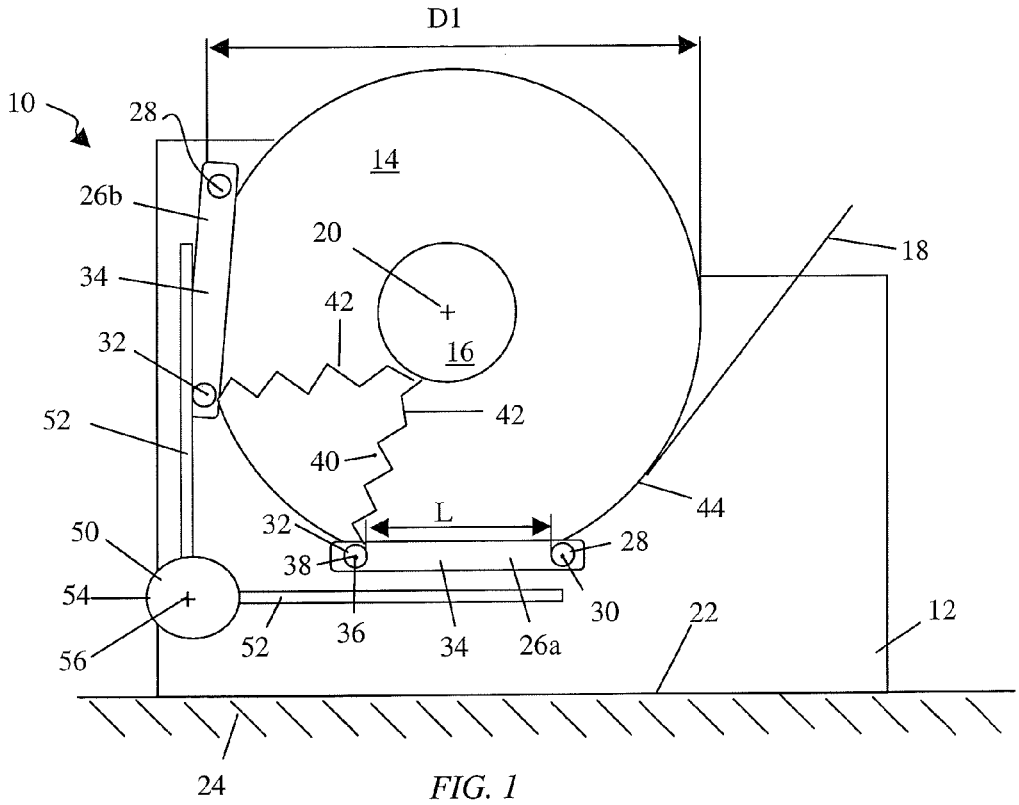
FIG. 1 is a cross-sectional view of a horizontally-oriented printer.
Figure 2:
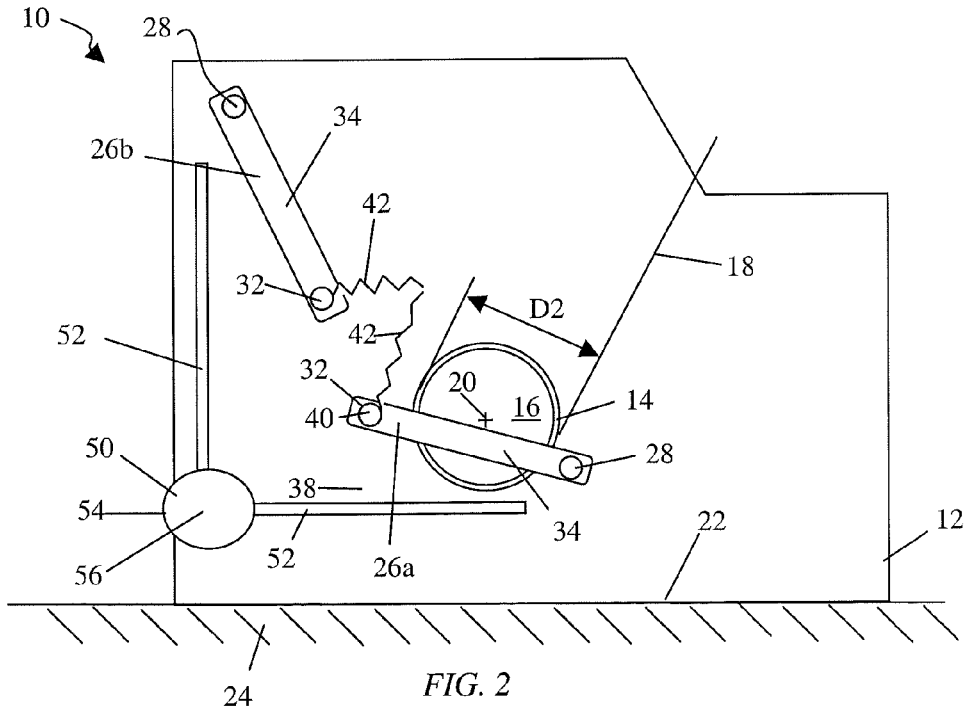
FIG. 2 is a cross sectional view of the printer of FIG. 1 with a partially depleted paper supply roll.

Referring to FIG. 1, a printer 10 includes a housing 12 which contains a paper supply roll 14. The paper supply roll 14, including a core 16 and a length of paper sheet 18 wrapped around the core 16, has a first diameter D1. During operation of the printer, as shown in FIG. 2, an amount of paper sheet 18 wrapped around the core 16 decreases as the paper supply roll 14 rotates about a supply roll axis 20 such that the first diameter D1 decreases to a second diameter D2.

Figure 3:
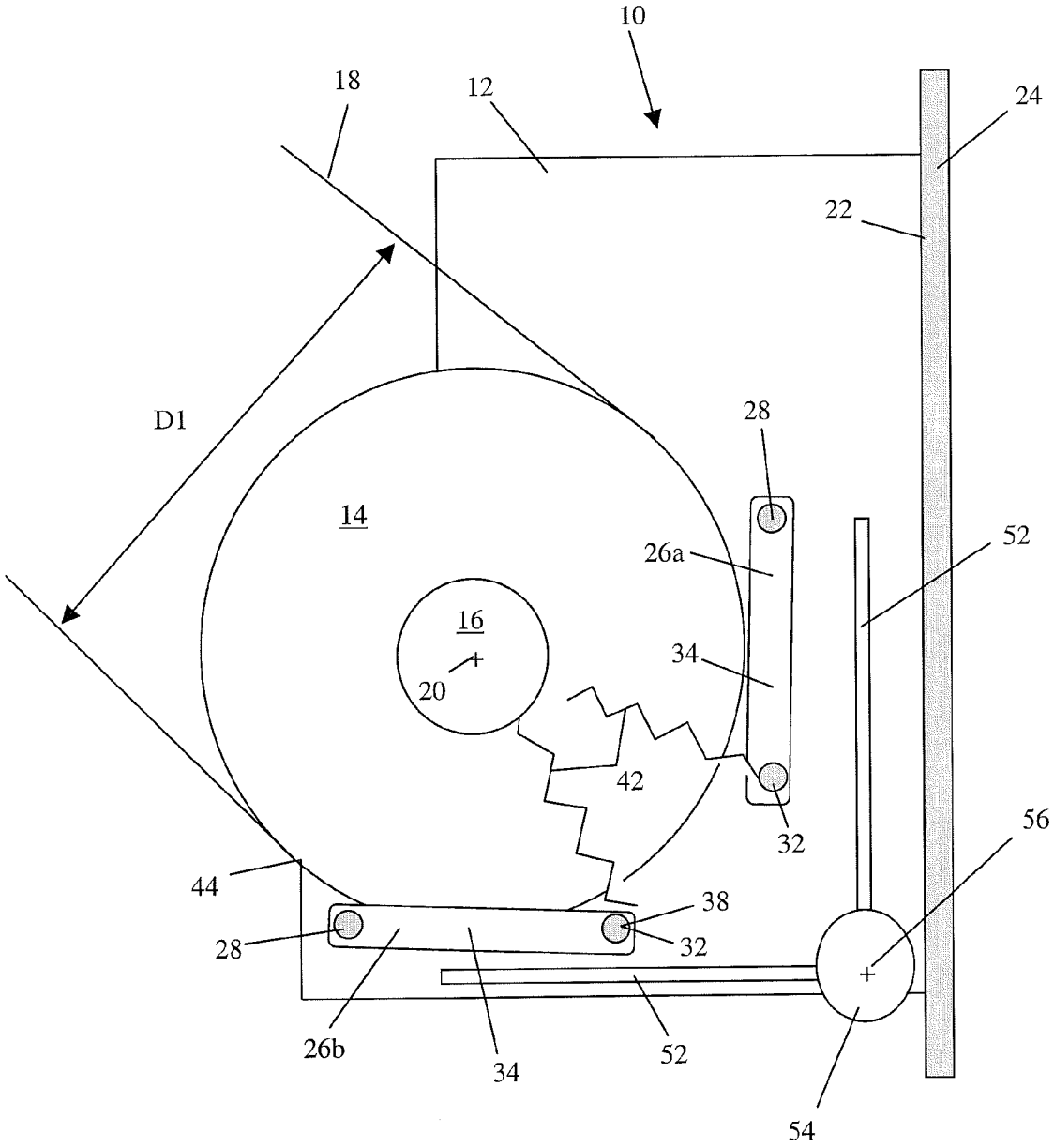
FIG. 3 is a cross-sectional view of a vertically-mounted printer.

The printer 10 is configured so that a base 22 of the printer 10 rests on a mounting surface 24. In some embodiments, the mounting surface 24 may be, for example, a table or desk such that the printer 10 is generally oriented horizontally. In other embodiments, as shown in FIG. 3, the mounting surface 24 is, for example, a wall such that the printer 10 is generally oriented vertically.

Referring again to FIG. 1, the printer 10 includes two paper supports 26*a*, 26*b*. The two paper supports 26*a*, 26*b* are substantially identical, so for the sake of brevity, the structure of one paper support 26 will be described herein. Each paper support 26 includes a fixed roller 28 fixed to the housing 12 and rotatable about a fixed roller axis 30. A movable roller 32 is disposed in the housing and located at a predetermined distance L from the fixed roller 28 via, for example, at least one connecting link 34 which extends from the fixed roller axis 30 to a movable roller axis 36. Thus, the movable roller 32 is rotatable about the movable roller axis 36 and movable about the fixed roller axis 30 at the distance L between a start position 38 and an end position 40. The movable roller 32 is biased toward the end position 40 by a biasing member 42, which in some embodiments is a spring.

Paper support 26*a* is disposed in the housing 10 such that when the printer 10 is located on a horizontal mounting surface 24, as shown in FIG. 1, the paper supply roll 14 is positioned in the housing 12 by gravity such that an outer surface 44 of the paper supply roll 14 is maintained in contact with the fixed roller 28 and the movable roller 32 of paper support 26*a* while paper sheet 18 is drawn from the paper supply roll 14 during operation of the printer 10. Similarly, when the printer 10 is located on a vertical mounting surface 24, as shown in FIG. 3, the paper supply roll 14 is positioned in the housing 12 by gravity such that the outer surface 44 of the paper supply roll 14 is maintained in contact with the fixed roller 28 and the movable roller 32 of paper support 26*b* while paper sheet 18 is drawn from the paper supply roll 14 during operation of the printer 10.

Figure 4:
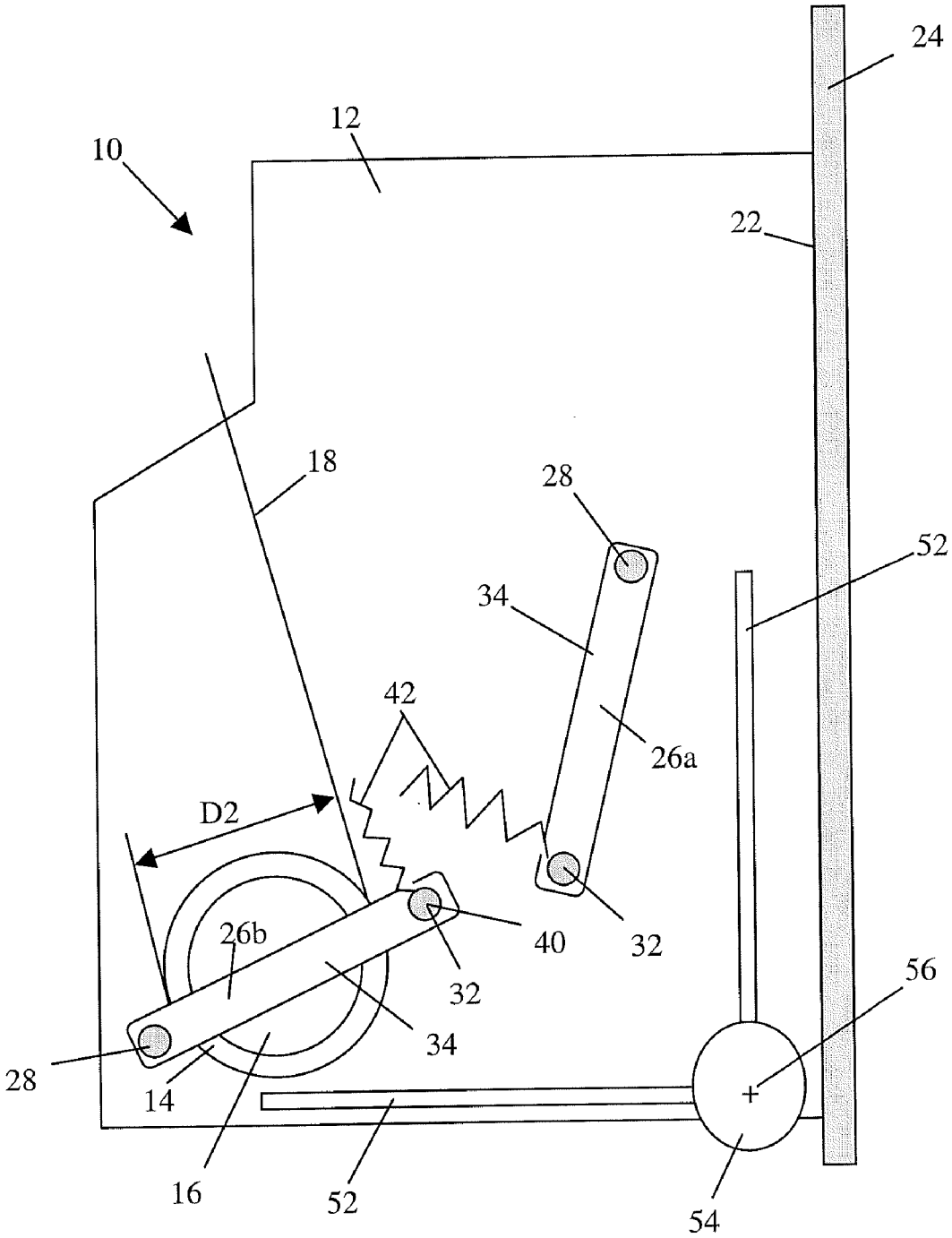
FIG. 4 is a cross-sectional view of the printer of FIG. 3 with a partially depleted paper supply roll.

As shown in FIG. 1, when the paper supply roll 14 has a diameter D1, the mass of the paper supply roll 14 and gravity exert a force F on the fixed roller 28 and the movable roller 32 to overcome a bias force exerted by the biasing member 42 such that the movable roller 32 remains at the start position 38. During operation of the printer 10, paper sheet 18 is drawn from the paper supply roll 14, thereby reducing the diameter of the paper supply roll 14 from D1 toward D2, as shown in FIG. 2. As the diameter reduces from D1 to D2, a magnitude of the force F on the movable roller 32 is reduced due to a reduction of mass of the paper supply roll 14, and allows the movable roller 32 to move from the start position 38 toward the end position 40. When the paper supply roll 14 diameter is equal to or less than the distance L between the movable roller 32 and the fixed roller 28, the paper supply roll 14 is allowed to fall between the fixed roller 28 and the movable roller 32. It will be appreciated that while this has been illustrated with printer 10 in a substantially horizontal position and the paper supply roll 14 resting on paper support 26*a*, the printer 10 functions identically with the printer 10 in a substantially vertical orientation and the paper supply roll 14 resting on paper support 26*b*, as shown in FIGS. 3 and 4.

Figure 5:
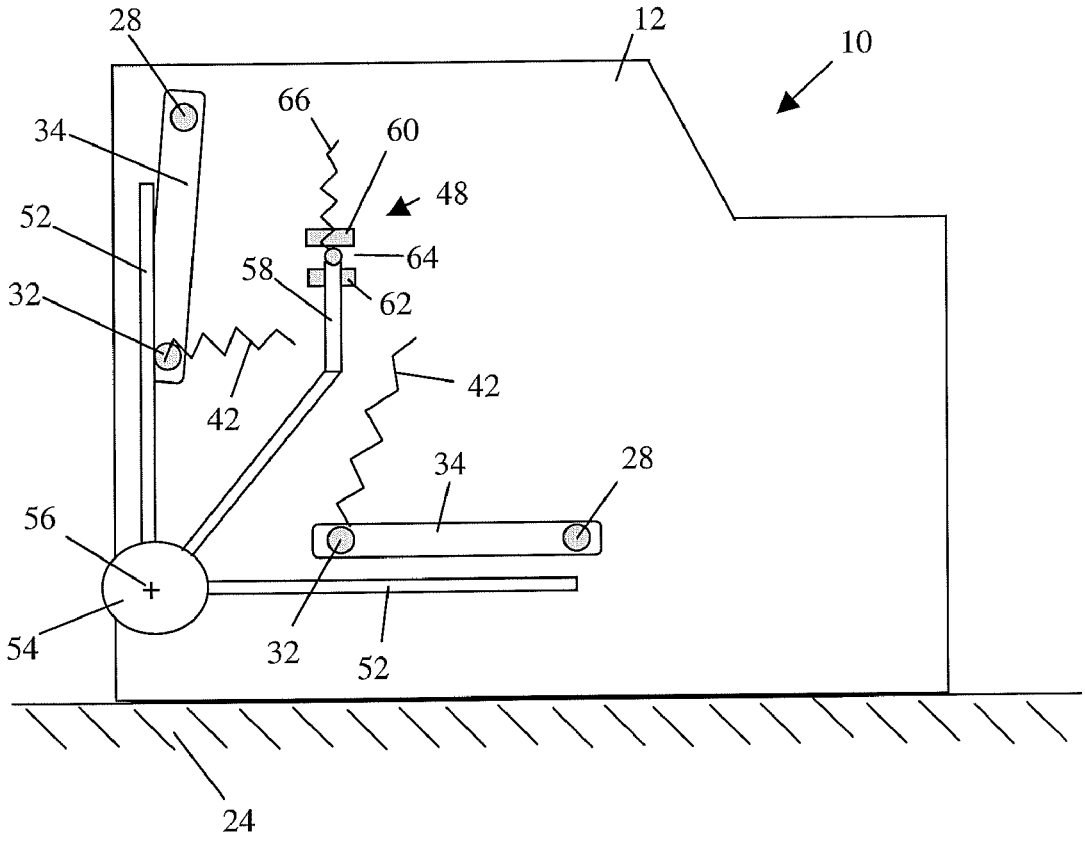
FIG. 5 is a perspective view of a detection device for the printer.

As best shown in FIG. 5, the printer 10 includes a detection device 46 which includes, in some embodiments, a sensor 48 and a paddle assembly 50. The paddle assembly 50 includes two paddles 52 extending from a pivot bar 54. The paddle assembly 50 is disposed in the housing 12 such that each paddle 52 extends beneath a paper support 26, and is rotatable about a bar axis 56. A paddle trip arm 58 extends from the pivot bar 54 toward the sensor 48. The sensor 48 includes an emitting element 60 and a receiving element 62 which are disposed in a line-of-sight 64 of each other, such that an optical beam, for example, may be emitted from the emitting element 60 and received by the receiving element 62.

The paddle trip arm 58 is biased to a home position, as shown in FIG. 5, which disrupts the line-of-sight 64 by a paddle bias element 66, which in some embodiments is a spring. When, as described above, the paper supply roll 14 allowed to fall between the fixed roller 28 and the movable roller 32 of either paper support 26*a* or 26*b*, the paper supply roll lands on of the two paddles 52. The paper supply roll 14 exerts a force on the paddle 52 sufficient to overcome a biasing force of the paddle bias element 66, thus rotating the paddle assembly 50 about the bar axis 56. When the paddle assembly 50 rotates a sufficient amount, the paddle trip arm 58 rotates out of the line-of-sight 64 thereby triggering the sensor 48 to indicate a low paper condition.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. A low paper sensor mechanism for a printer comprising:

two paper supports, the first paper support supportive of a paper supply roll when the printer is mounted to a substantially horizontal surface and the second paper support supportive of the paper supply roll when the printer is mounted to a substantially vertical surface, each paper support including:

a fixed roller rotatable about a fixed roller axis;

a movable roller rotatable about a movable roller axis and pivotable about the fixed roller axis from a start position to an end position, the movable roller and fixed roller spaced a predetermined distance apart and capable of supporting a paper supply roll; and a biasing member in operable communication with the movable roller and capable of biasing the movable roller toward the end position; and a detection device including:

a sensor having an emitting element and a detecting element, the emitting element being disposed in a line of sight of the detecting element;

a paddle assembly having two paddles, one paddle extending beneath each paper support from a central bar and a trip arm extending from the central bar; and a paddle biasing member disposed to bias the trip arm to disrupt the line of sight;

wherein the movable roller is translatable from the start position toward the end position as a diameter of the paper supply roll decreases to less than or equal to the predetermined distance thereby allowing the paper supply roll to fall between the fixed roller and the movable roller thus exerting a force on one paddle of the two paddles causing the paddle assembly to rotate about a bar axis thereby restoring the line of sight.

* * * * *